US005575713A

United States Patent [19]

Benoit et al.

[11] Patent Number: 5,575,713

[45] Date of Patent: Nov. 19, 1996

[54] PLASTIC FASTENER

[75] Inventors: James C. Benoit, Needham; Frank T. McCarthy, Lowell; Gary Buchholz, Winchendon, all of Mass.

[73] Assignee: Avery Dennison Corporation, Pasadena, Calif.

[21] Appl. No.: 560,271

[22] Filed: Nov. 2, 1995

Related U.S. Application Data

[63] Continuation-in-part of Ser. No. 488,622, Jun. 8, 1995.

[51] Int. Cl.[6] ..... G09F 3/08; B65C 7/00

[52] U.S. Cl. ..... 452/198; 12/142 LC; 24/704.1; 40/662; 40/663; 227/67

[58] Field of Search ..... 452/198; 40/663, 40/662, 668, 669; 24/704.1, 711.1, 30.5 P; 411/904, 907, 908

[56] References Cited

U.S. PATENT DOCUMENTS

| | | | |
|---|---|---|---|
| 3,103,666 | 9/1963 | Bone . | |
| 4,121,487 | 10/1978 | Bone . | |
| 4,456,161 | 6/1984 | Russell . | |
| 4,660,718 | 4/1987 | Kato et al. | 40/662 |
| 4,901,854 | 2/1990 | Bone et al. . | |
| 4,955,475 | 9/1990 | McCarthy et al. . | |
| 5,024,365 | 6/1991 | Bourque . | |
| 5,321,872 | 6/1994 | Merser | 24/704.1 |
| 5,373,656 | 12/1994 | Merser | 40/663 |
| 5,438,724 | 8/1995 | Merser | 12/142 LC |
| 5,447,263 | 9/1995 | Tropper et al. | 227/67 |

FOREIGN PATENT DOCUMENTS

| | | | |
|---|---|---|---|
| 961265 | 1/1975 | Canada | 40/662 |
| 420831 | 3/1961 | Switzerland | 40/662 |

*Primary Examiner*—Willis Little
*Attorney, Agent, or Firm*—Kriegsman & Kriegsman

[57] ABSTRACT

A plastic fastener which may be inserted into a body of meat for tagging purposes and then subsequently removed therefrom intact comprises an elongated unitary plastic member shaped to include a transverse bar, a paddle, and a flexible filament interconnecting the transverse tag and paddle. The transverse bar is interconnected to the filament in a T shaped configuration. In one embodiment, the portion of the transverse bar constituting the trailing end thereof when the transverse bar is inserted into the meat is made smaller than normal so as to minimize the likelihood of the transverse bar severing from the filament when the fastener is withdrawn from the body of the meat. In another embodiment, the transverse bar is connected at its midpoint to the filament, the length of the transverse bar being made smaller than normal and the filament having an ovaloid cross-section so as to prevent the severing of the transverse bar from the filament, The major axis of the filament cross-section being parallel to the axis of the transverse bar.

7 Claims, 3 Drawing Sheets

PLASTIC FASTENER

CROSS-REFERENCE TO RELATED APPLICATIONS

This application is a continuation-in-part of pending. U.S. patent application Ser. No. 08/488,622, filed Jun. 8, 1995, in the names of James C. Benoit, Frank T. McCarthy, and Gary Buchholz.

BACKGROUND OF THE INVENTION

The present invention relates generally to plastic fasteners and more particularly to a plastic fastener which is especially useful in tagging meat but which is also useful in many other applications where a fastener is either desired or required.

Plastic fasteners are well known and widely used in a variety of applications. One such application is tagging meat. Fasteners constructed for this purpose generally are of the type comprising an elongated plastic member having a thin filament, circular in cross-section, a transverse bar at one end of the filament and a paddle at the other end of the filament. The transverse bar is connected to the filament in a T shaped configuration with the portions of the transverse bar on each side of the filament being equal in length. The transverse bar typically has a length of about 0.40 inches or greater and a cross sectional diameter of about 0.045 inch. Usually, such fasteners are massproduced by a molding process in either one of two different forms known as fastener stock. One type of fastener stock, which is shown in commonly-assigned U.S. Pat. No. 3,103,666 and incorporated hereunto by reference, comprises a plurality of fasteners joined together at their respective transverse bars by an orthogonally disposed runner bar. The other type of fastener stock, which is shown in commonly-assigned U.S. Pat. No. 4,955,475 and incorporated hereunto by reference, comprises a plurality of fasteners arranged in an end-to-end alignment, the heads and opposite ends of successive fasteners being joined together by severable connectors so as to form a continuously connected fastener stock.

Typically, the transverse bar portion of a single fastener is separated from a quantity of fastener stock and then inserted into the meat being tagged with a hand-held apparatus commonly referred to as a tagging gun. Connections, if any, between the paddles of a pair of adjacent fasteners are severed by pulling the tagging gun away from the item after the transverse bar of one of the fasteners has been inserted thereunto. Examples of tagging guns are illustrated in commonly-assigned U.S. Pat. Nos. 5,024,365, 4,121,487, and 4,456,161, all of which are incorporated hereunto by reference, as well as the above noted U.S. Pat. No. 3,103,666.

When being used to tag meat, after the fastener is inserted in the meat and the meat has been inspected and/or further processed, the fastener is usually pulled back out and discarded.

It has been found that in some instances, especially when the meat has been chilled and the fastener has been inserted, when a person attempts to pull the fastener back out it will break at the junction of the transverse bar and the filament leaving the transverse bar embedded in the meat. The severed transverse bar must then be removed, either by hand or with an appropriate tool. This, of course, is time consuming, difficult, and costly.

SUMMARY OF THE INVENTION

It is an object of the present invention to provide a new and improved plastic fastener.

It is another object of the present invention to provide a plastic fastener which is especially useful in tagging meat.

It is still another object of the present invention to provide a plastic fastener especially designed for intact removal from a solid type object such as meat into which it has been embedded.

It is yet still another object of the present invention to provide a plastic fastener of the type described above which can be mass-produced according to conventional techniques to form fastener stock of either the continuously connected variety or the runner bar variety and which can be dispensed using conventional tagging guns.

In furtherance of the objects broadly set forth above, such a fastener comprises in one embodiment an elongated filament, circular in cross-section and a transverse bar disposed at one end thereof, the transverse bar being interconnected to the filament in a T shaped configuration with the portion of the transverse bar constituting the trailing end thereof when the transverse bar is inserted into the meat being sized smaller than normal in order to reduce the likelihood that the transverse bar will break off when the fastener is subsequently withdrawn from the meat and the other portion of the transverse bar being the normal size to prevent slippage of the fastener after it is inserted into the meat.

In another embodiment of the invention the transverse bar of the first embodiment is interconnected to the filament in an L shaped configuration rather than a T shaped configuration, the leg portion of the L shape serving as the leading edge of the transverse bar.

In a third embodiment of the present invention, the transverse bar of the first embodiment is connected at its midpoint to the filament, the length of the transverse bar being sized smaller than normal and the filament having an ovaloid cross-section in order to reduce the likelihood that the transverse bar will break off when the fastener is subsequently withdrawn from the meat, with the major axis of the filament being parallel to the axis of the transverse bar.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
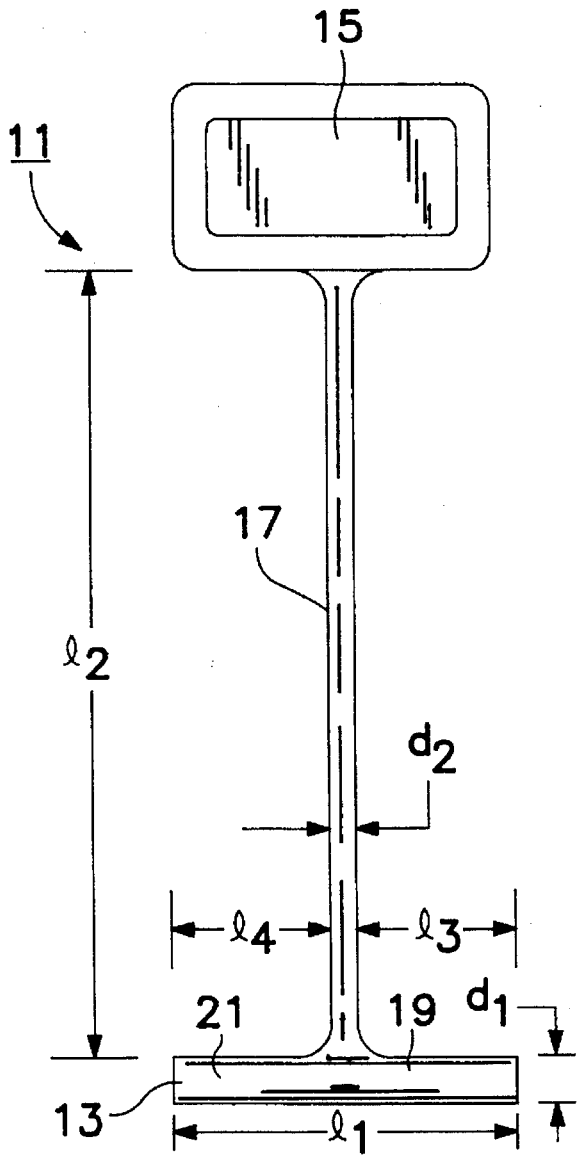
FIG. 1 PRIOR ART
FIG. 1 is a side view of a prior art plastic fastener.

Referring now to FIG. 1 there is shown a prior art plastic fastener of the type used for tagging a body of meat, the prior art plastic fastener being represented generally by reference numeral 11.

Fastener 11 is an elongated unitary plastic member shaped to define a transverse bar 13, a paddle 15, and a filament 17, filament 17 interconnecting transverse bar 13 and paddle 15. Transverse bar 13 has a length $I_1$ of about 0.400 inches and a cross-sectional diameter $d_1$ of about 0.045 inches. Filament 17 has a length $I_2$ of about 2 inches, is circular in cross-section and has a cross-sectional diameter $d_2$ of about 0.035 inches.

Transverse bar 13 is connected at its midpoint to filament 17 to form a T shape configuration. The legs of the T in transverse bar 13 are identified by reference numerals 19 and 21, respectively, each leg 19 and 21 having a length $I_3$ and $I_4$, respectively of about 0.20 inches. When transverse bar 13 is inserted into a body of meat (not shown) by a suitable tagger gun, leg 19 is the leading end whereas leg 21 is the trailing end i.e. the end contacted by the ejector rod in the tagger gun. As can readily be appreciated, fastener 11 may be molded as part of a quantity of either continuously connected fastener stock or fastener stock of the type having an orthogonally disposed runner bar.

Figure 2:
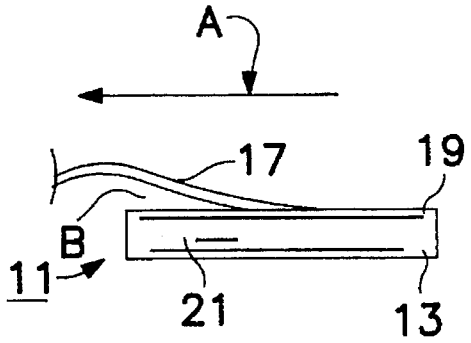
FIG. 2 PRIOR ART
FIG. 2 is a side section view showing how the plastic fastener shown in FIG. 1 appears when it is being withdrawn from a body of meat.

Referring now to FIG. 2 there is shown a view of how fastener 11 appears as it is being pulled out from a body of meat after insertion therein, the direction of withdrawal being shown by arrow A. As can be seen, meat will collect in the area B, i.e. the area between filament 17 and trailing end 21 of transverse bar 13.

It is believed that this buildup of meat in area B as fastener 11 is withdrawn will occasionally cause transverse bar 13 to sever from filament 17 at the junction of filament 17 and leg 21.

Figure 3:
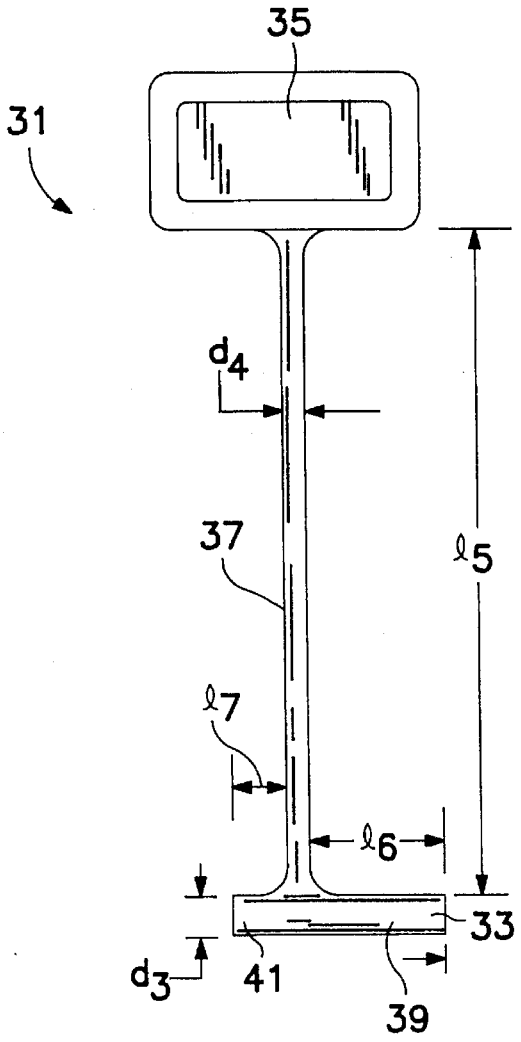
FIG. 3 is a side view of a first embodiment of a plastic fastener constructed according to the teachings of the present invention.
Figure 5:
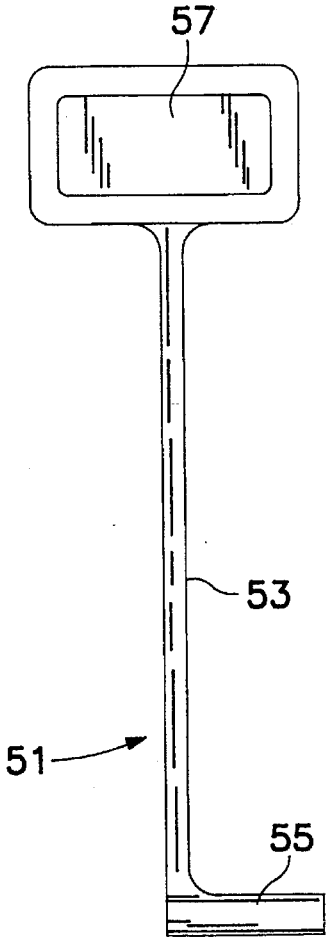
FIG. 5 is a side view of a second embodiment of a plastic fastener constructed according to the teachings of the present invention.
Figure 4:
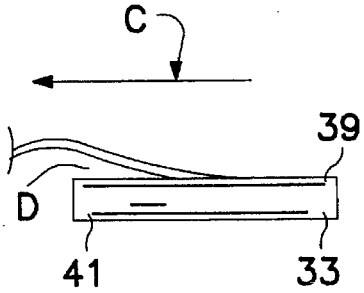
FIG. 4 is a side section view illustrating how the plastic fastener of FIG. 3 appears when it is being withdrawn from a body of meat.

Referring now to FIGS. 3 through 5, there is shown a first embodiment of a plastic fastener constructed according to the teachings of the present invention, the plastic fastener being represented generally by reference numeral 31.

As can readily be seen, plastic fastener 31 is similar in construction and composition to plastic fastener 11, plastic fastener 31 being an elongated unitary plastic member shaped to define a transverse bar 33, a paddle 35, and a filament 37, filament 37 being circular in cross-section and interconnecting transverse bar 33 and paddle 35. Transverse bar 33 has a cross-sectional diameter $d_3$ about 0.045 inches and filament 37 has a length $I_5$ of about 2 inches and a cross sectional diameter $d_4$ of about 0.035 inches. Leg 39 of bar 33 has a length $I_6$ about 0.200 inches. To this extent, fastener 31 is the same as fastener 11. Plastic fastener 31 differs from plastic fastener 11, however, in that leg 41 of bar 33 has a length $I_7$ of only about 0.050 inches. As illustrated in FIG. 4, because of the shortened length $I_7$ of leg 41 when fastener 31 is being withdrawn from a body of meat in the direction as shown by arrow C, less meat will accumulate in the area D between leg 41 and filament 37 then in area B, because the area is smaller. Thus the likelihood of bar 33 breaking off from filament 37 will be reduced.

In FIG. 5 there is shown a second embodiment of the present invention, identified by reference numeral 51. Fastener 51 differs from fastener 31 in that leg 41 is completely eliminated. Thus, fastener 51 includes a filament 53, a transverse bar 55 and a paddle 57, the transverse bar being connected at one end to filament 53 to form a L shape. Since the leg at the trailing edge is completely eliminated, there is no area corresponding to area B in FIG. 2 or area D in FIG. 4 where meat can build up when the fastener is withdrawn.

Figure 6:
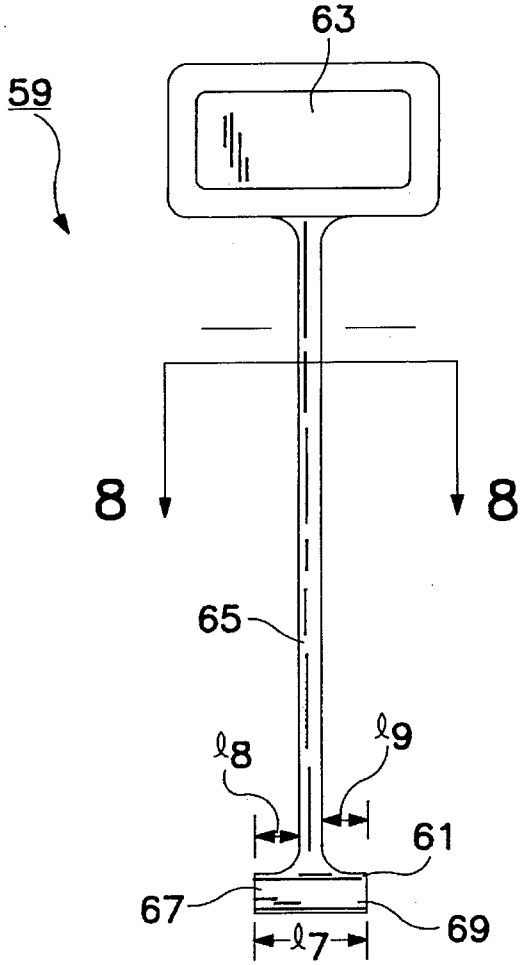
FIG. 6 is a side view of a third embodiment of a plastic fastener constructed according to the teachings of the present invention.

In FIG. 6 there is shown a third embodiment of the present invention, identified by reference numeral 59. As can readily be seen, plastic fastener 59 is similar in construction and composition to plastic fastener 11, plastic fastener 59 in that it comprises an elongated unitary plastic member shaped to define a transverse bar 61, a paddle 63, and a filament 65, filament 65 interconnecting transverse bar 61 and paddle 63.

Plastic fastener 59 differs from plastic fastener 11, however, in that transverse bar 61 has a length $I_7$ of about 0.170 inches whereas, as noted above, transverse bar 13 of fastener 11 has a length $I_1$ of 0.400 inches or greater. Transverse bar 61 is connected at its midpoint to filament 65 to form a T shape configuration. The legs of the T in transverse bar 61 are identified by reference numerals 67 and 69, respectively, each leg 67 and 69 having a length $I_8$ and $I_9$, respectively, of about 0.085 inches.

Because of the shortened length $I_7$ of transverse bar 61, when fastener 59 is being withdrawn from a body of meat, less meat will accumulate at the junction of transverse bar 61 and filament 65. Thus, the likelihood of bar 61 breaking off from filament 65 will be reduced.

Figure 8:
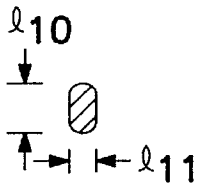
FIG. 8 is a sectional view of the plastic fastener of FIG. 6 taken along lines 8.
Figure 7:
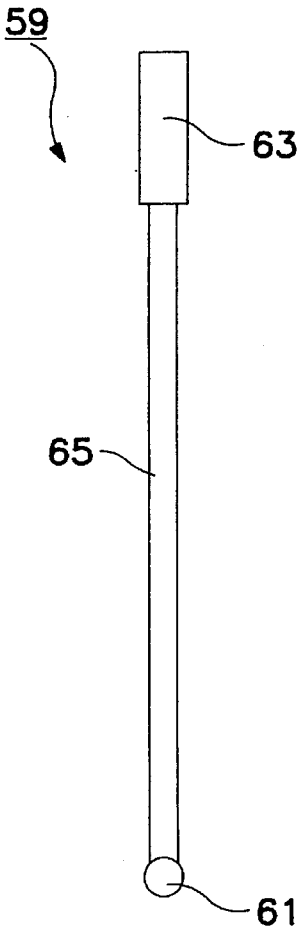
FIG. 7 is a front view of the plastic fastener shown in FIG. 6.

Plastic fastener 59 also differs from plastic fastener 11 in that cross-section of filament 65 is ovaloid whereas, the cross-section of filament 17 is circular. The major axis of filament 65 is parallel to the axis of transverse bar 61. FIG. 8 shows the cross-section of filament 65 at the lines 8 of FIG. 6. Filament 65 has a cross-sectional major axis length $I_{10}$ of about 0.060 inches and a cross-sectional minor axis length $I_{11}$ of about 0.035 inches. In comparison, filament 17 of prior art fastener 11 has a cross-sectional diameter $d_2$ of 0.035 inches, which results in a substantially smaller cross-sectional surface area in filament 17 than in filament 65.

The increase in the overall cross-sectional surface area of filament 65 created by its ovaloid shape serves to increase the strength of filament 65, making it less susceptible to breaking off from transverse bar 61. It should be noted that the cross-sectional minor axis of filament 65 is maintained at the same length $I_{11}$ as the prior art cross-sectional diameter $d_2$ of filament 17, namely 0.035 inches, to enable plastic fastener 59 to fit through the longitudinal slot in a standard needle of a common tagging gun.

It should also be noted that filaments 37 and 53 of the first and second embodiments, respectively, could also be made ovaloid in cross-section rather than circular in cross-section.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A plastic fastener for use in tagging meat or other similar object, said fastener comprising:

a. an elongated filament having a first end and a second end; and b. a transverse bar disposed at the first end of said elongated filament, said transverse bar being insertable into the meat or other similar object and said transverse bar being interconnected to said filament in an L shaped configuration so as to reduce the likelihood that said transverse bar will break off from said filament on withdrawal of said fastener from the meat or other similar object;

c. wherein said filament has an ovaloid cross-section, the major axis being parallel to the axis of said transverse bar.

2. A plastic fastener for use in tagging meat or other similar object, said fastener comprising:

a. an elongated filament having a first end and a second end; and b. a transverse bar disposed at the first end of said elongated filament, said transverse bar being insertable into the meat or other similar object and said transverse bar being interconnected to said filament in a T shaped configuration wherein the portion of said transverse bar on one side of the filament is shorter than the portion of the transverse bar on the other side of said filament so as to reduce the likelihood that said transverse bar will break off from said filament on withdrawal of said fastener from the meat or other similar object;

c. wherein said filament has an ovaloid cross-section, the major axis being parallel to the axis of said transverse bar.

3. A plastic fastener for use in tagging meat or other similar object, said fastener comprising:

a. an elongated filament having a first end and a second end; and b. a transverse bar disposed at the first end of said elongated filament, said transverse bar being insertable into the meat or other similar object and said transverse bar being interconnected to said filament in a T shaped configuration so as to reduce the likelihood that said transverse bar will break off from said filament on withdrawal of said fastener from the meat or other similar object;

c. wherein said filament has an ovaloid cross-section, the major axis being parallel to the axis of said transverse bar.

4. The fastener as claimed in claim 3 wherein the portion of said transverse bar on one side of said filament is about equal to the portion of said transverse bar on the other side of said filament.

5. The fastener as claimed in claim 4 wherein the overall length of said transverse bar is about 170 inches.

6. The fastener as claimed in claim 5 wherein the cross-sectional major axis length of said filament is about 0.060 inches.

7. The fastener as claimed in claim 6 wherein the cross-sectional minor axis length of said filament is about 0.035 inches.

* * * * *